US007143999B2

(12) United States Patent
Ogishi

(10) Patent No.: US 7,143,999 B2
(45) Date of Patent: Dec. 5, 2006

(54) ACCELERATING APPARATUS OF CARBURETOR

(75) Inventor: Yasuaki Ogishi, Kawasaki (JP)

(73) Assignee: Keihin Corporation, Tokyo (JP)

( * ) Notice: Subject to any disclaimer, the term of this patent is extended or adjusted under 35 U.S.C. 154(b) by 0 days.

(21) Appl. No.: 11/209,321

(22) Filed: Aug. 23, 2005

(65) Prior Publication Data

US 2006/0082005 A1 Apr. 20, 2006

(30) Foreign Application Priority Data

Oct. 14, 2004 (JP) ..... 2004-300400

(51) Int. Cl.
*F02M 7/093* (2006.01)

(52) U.S. Cl. ..... 261/34.2; 123/438; 261/DIG. 74

(58) Field of Classification Search ..... 261/34.2, 261/35, 69.1, 69.2, DIG. 68, DIG. 74; 123/438
See application file for complete search history.

(56) References Cited

U.S. PATENT DOCUMENTS 4,168,680 A * 9/1979 Kawai et al. ..... 261/39.1
4,446,080 A * 5/1984 Karino et al. ..... 261/39.5
4,457,278 A * 7/1984 Habel et al. ..... 123/438
4,572,134 A * 2/1986 Nouthuka et al. ..... 123/438
5,465,698 A * 11/1995 Benholz ..... 123/438
5,611,312 A * 3/1997 Swanson et al. ..... 123/436
5,632,248 A * 5/1997 Sugii ..... 123/438
5,775,300 A * 7/1998 Sugii ..... 123/438
5,794,593 A * 8/1998 Sugii ..... 123/438
6,401,685 B1 * 6/2002 Warner ..... 123/198 DB
6,581,916 B1 * 6/2003 Shaw ..... 261/35
2005/0017378 A1 * 1/2005 Burns ..... 261/35

FOREIGN PATENT DOCUMENTS

JP 54-155321 * 12/1979 ..... 261/DIG. 74
JP 59-65547 * 4/1984 ..... 261/DIG. 74

* cited by examiner

*Primary Examiner*—Richard L. Chiesa
(74) *Attorney, Agent, or Firm*—R. Neil Sudol; Henry D. Coleman; William J. Sapone

(57) ABSTRACT

To inhibit an after burn phenomenon, an accelerating apparatus (P) is sectioned into a pump chamber (23) and a pressure receiving chamber (24) by a partition body (20), an acceleration fuel intake path (25) and an acceleration fuel discharge path (28) are open to the pump chamber (23), and a fuel discharge path (30*b*) is open to a float chamber (8), a negative pressure introducing path (30*a*) is open to the pressure receiving chamber (24), a pump spring (31) is provided compressedly in the pressure receiving chamber (24), and a valve body (34) is formed by a jet opening and closing valve portion (34*a*) opening and closing an opening portion (6*a*) of a main fuel jet (6) when an engine operates and stops respectively by a solenoid apparatus (S), and a discharge path opening and closing valve portion (34*b*) opening and closing the fuel discharge path (30*b*) when an engine stops and operates respectively, and synchronously moves with a movable core (17) of the solenoid apparatus (S).

2 Claims, 4 Drawing Sheets

PRIOR ART

PRIOR ART

ACCELERATING APPARATUS OF CARBURETOR

TECHNICAL FIELD

The present invention relates to a carburetor which adjusts and controls a concentration and an amount of an air-fuel mixture supplied to an engine, and relates to an accelerating apparatus which injects and supplies acceleration fuel toward the engine at a time of an accelerated drive of the engine, more particularly to a so-called negative pressure actuation type accelerating apparatus which actuates increase and decrease of a chamber volumetric capacity of a pump chamber by using a change in negative pressure generated in a downstream side of a throttle valve.

BACKGROUND ART

A conventional accelerating apparatus of a carburetor is shown in FIG. 4.

Reference numeral 1 denotes a carburetor main body in which an intake passage 2 is provided so as to pass through. A lower opening portion 1*a* open downward is formed in a lower side of the intake passage 2, and a lower mounting collar portion 1*b* is formed in an outer periphery of a lower end of the lower opening portion 1*a*.

The intake passage is provided so as to pass through from a front side toward a back side of a paper surface in FIG. 5, a venturi portion 2*a* where a diameter is most narrowed down is formed in an approximately intermediate portion of the intake passage 2, an intake passage 2*b* which is arranged in a downstream side from the venturi portion 2*a* is formed toward a front side from the venturi portion 2*a*, and an intake passage 2*c* which is arranged in an upstream side from the venturi portion 2*a* is formed toward a backside from the venturi portion 2*a*.

Further, the intake passage 2*c* in the upstream side from the venturi portion is connected to an air cleaner (not shown), and the intake passage 2*b* in the downstream side from the venturi portion 2*a* is connected to an intake pipe of an engine (not shown).

Accordingly, clean air from which a foreign material is removed by the air cleaner flows to the intake passage 2*c* in the upstream side from the venturi portion 2*a*, the venturi portion 2*a*, and the intake passage 2*b* in the downstream side from the venturi portion 2*a*, and is supplied to the engine.

Further, a butterfly type throttle valve 3 is arranged within the intake passage 2*b* in the downstream side from the venturi portion 2*a* as shown in FIG. 5, and the throttle valve 3 is attached to a throttle valve shaft 4 which is rotatably supported to the carburetor main body 1.

Accordingly, the throttle valve 3 controls so as to open and close an opening area of the intake passage 2*b* in the downstream side from the venturi portion 2*a* on the basis of a rotational operation of the throttle valve shaft 4, whereby an amount of air supplied from the intake passage 2 toward the engine is controlled.

Further, a main fuel nozzle 5 and a main fuel jet 6 are arranged in a lower side of the intake passage 2, an upper end 5*a* of the main fuel nozzle 5 is arranged so as to protrude to the venturi portion 2*a* and is open therein, and a lower opening portion 6*a* of the main fuel jet 6 is arranged so as to be open downward.

Reference numeral 7 denotes a closed-end cup-shaped float chamber main body open upward. An upper mounting collar portion 7*a* is formed in an outer periphery of an upper end of the float chamber main body 7. A float chamber 8 is formed with a lower opening portion 1*a* of the carburetor main body 1 and an opening portion to an upper side of the float chamber main body 7, by bringing the upper mounting collar portion 7*a* of the float chamber main body 7 into contact with the lower mounting collar portion 1*b* of the carburetor main body 1 and fastening both by a screw.

Further, a fixed fuel liquid surface X—X is formed within the float chamber 8 on the basis of a cooperating effect of a float 9, a valve seat 11 arranged in an end portion of a fuel inflow path 10 connected to a fuel tank T, and a float valve 12 opening and closing the valve seat 11, as shown in FIG. 5.

In this case, the lower opening portion 6*a* of the main fuel jet 6 mentioned above is open below the fixed liquid surface X—X in the float chamber 8.

The opening portion 6*a* of the main fuel jet 6 is electrically opened and closed by a valve body V actuated by a solenoid apparatus S.

The solenoid apparatus S is provided with an electromagnetic coil 15 wound around a coil bobbin 14, a stationary core 16 fixed to a case 13, a movable core 17 movably arranged so as to oppose to the stationary core 16, and a spring 18 energizing the movable core 17 so as to move the movable core 17 apart from the stationary core 16, within a case 13.

Further, the valve body V is provided with a valve body Va opening and closing the opening portion 6A of the main fuel jet 6, and the valve body V is integrally formed with the movable core 17 so as to be synchronously moved with the movable core 17.

The solenoid apparatus is fixed by screw to an outer periphery of a lower side of the float chamber main body 7, and the valve body V passes through a bottom portion of the float chamber main body 7 and is opposed to the opening portion 6*a* of the main fuel jet 6.

A negative pressure actuation type accelerating apparatus P is formed in the following manner.

Reference symbol 7*b* denotes a pump chamber recess portion which is recessed toward a right side wall 7*c* of the float chamber main body 7, a partition body 20 constituted by a diaphragm is arranged in a right opening portion of the pump chamber recess portion 7*b*, a pressure receiving chamber cover 21 in which a pressure receiving chamber recess portion 21*a* formed in a closed-end cup shape is recessed is arranged on the partition body 20 so as to be brought into contact therewith, and the pressure receiving chamber cover 21 is fixed by a screw 22 toward the right side wall 7*c* of the float chamber main body 7 via the partition body 20 in this state.

In accordance with the structure mentioned above, a sealed pump chamber 23 is formed by a left side surface of the partition body 20 and the pump chamber recess portion 7*b*, and a sealed pressure receiving chamber 24 is formed by a right side surface of the partition body 20 and the pressure receiving chamber recess portion 21*a*.

Further, an acceleration fuel intake path 25 connected to a portion below the fixed liquid surface X—X of the float chamber 8 is arranged to be open in the pump chamber 23, and an intake side check valve 26 allowing only a fuel flow from the float chamber 8 into the pump chamber 23 is arranged within the acceleration fuel intake path, in the pump chamber 23.

Further, an acceleration fuel discharge path 28 connected to the upstream side intake passage 2*c* from the venturi portion 2*a* via an accelerating nozzle 27 is arranged in the pump chamber 23 to be open therein, and a discharge side check valve 29 allowing only a fuel flow from the pump chamber 23 toward the accelerating nozzle 27 is arranged within the acceleration fuel discharging path 28.

On the other hand, a negative pressure introducing path 30*a* connected to an intake passage 2*ba* in a downstream side from the throttle valve 3 is arranged within the pressure receiving chamber 24 to be open therein, and a pump spring 31 is provided compressedly within the pressure receiving chamber 24, as shown in FIG. 5, and the partition body 20 is always energized to the side of the pump chamber 23 by spring force of the pump spring 31.

In accordance with the carburetor provided with the accelerating apparatus mentioned above, since no negative pressure is generated within the intake passage 2*ba* in the downstream side from the throttle valve 3 at a time when the engine stops, pressure within the pressure receiving chamber 24 is kept at approximately the atmospheric pressure, whereby the partition body 20 is pressed and held closest to the pump chamber 23 by the pump spring 31, so that a chamber volumetric capacity of the pump chamber 23 is kept small. (This state is shown in FIG. 4.)

Next, when an ignition switch (not shown) is closed, and a start operation of the engine is executed, the throttle valve 3 is held at a low opening degree at the starting time mentioned above, whereby great negative pressure is generated within the intake passage 2*ba* in the downstream side from the throttle valve 3, and the negative pressure is introduced into the pressure receiving chamber 24 via the negative pressure introducing path 30*a*.

In accordance with the structure mentioned above, the partition body 20 moves to a side of the pressure receiving chamber 24 against a spring force of the pump spring 31 so as to increase the chamber volumetric capacity within the pump chamber 23. Accordingly, great negative pressure is generated within the pump chamber 23, the intake side check valve 26 opens the acceleration fuel intake path 25 as well as the discharge side check valve 29 closes the acceleration fuel discharge path 28, and fuel within the float chamber 8 is sucked and held within the pump chamber 23 via the acceleration fuel intake path 25.

Further, since the throttle valve 3 is opened from a low opening degree state toward middle and high opening degrees at a time of the engine accelerating operation in which the throttle valve 3 is opened from the low opening degree state toward the middle and high opening degree states, negative pressure in the downstream side from the throttle valve 3 is lowered (the lowering of the negative pressure means that the pressure comes close to the atmospheric pressure), the lowered smaller negative pressure is introduced into the pressure receiving chamber 24 via the negative pressure introducing path 30*a*, and negative pressure within the pressure receiving chamber 24 becomes small.

In accordance with the structure mentioned above, the partition body 20 moves to the side of the pump chamber 23 by the spring force of the pump spring 31, and reduces the chamber volumetric capacity of the pump chamber 23.

In accordance with the reduction of the chamber volumetric capacity in the pump chamber 23, the inside of the pump chamber 23 is pressurized, and pressure within the pump chamber 23 is increased. Further, the discharge side check valve 29 opens the acceleration fuel discharge path 28 as well as the intake side check valve 26 closes the acceleration fuel intake path 25, pressure of the fuel stored and held within the pump chamber 23 is increased, and the acceleration fuel is injected and supplied toward the inside of the intake passage 2*c* in the upstream side from the venturi portion 2*a* via the acceleration fuel discharge path 28 and the accelerating nozzle 27, whereby it is possible to achieve an improved accelerating operation of the engine.

Paying attention to the solenoid apparatus S provided with the valve body V, when the ignition switch is closed and the start operation of the engine is executed, the electromagnetic coil 15 is electrified, and the movable core 17 is attracted toward the stationary core 16 against spring force of the spring 18. Accordingly, the valve body V integrally formed with the movable core 17 moves downward in FIG. 4, and the valve portion Va opens the opening portion 6*a* of the main fuel jet 6. The opening of the opening portion 6*a* by the valve portion Va is continuously executed during the operation of the engine.

Accordingly, an improved engine operation can be achieved without preventing fuel flow from the fuel jet 6 toward the main fuel nozzle S during the operation of the engine.

On the other hand, when opening the ignition switch so as to stop the engine, the engine rotates on the basis of an inertia rotation, and the rotating speed is gradually lowered and stops after a certain time passes.

Further, the throttle valve 3 automatically opens the intake passage on the basis of a governor mechanism provided in the engine (the governor mechanism and the throttle valve shaft 4 of the carburetor are connected via a governor rod, and the governor mechanism and the governor rod are not illustrated).

In accordance with the matter that the throttle valve 3 is automatically opened by the governor mechanism and the engine rotates by inertia although being at the low rotation speed, just after the engine stops as mentioned above, air flow is generated within the intake passage 2, negative pressure is generated in the venturi portion 2*a*, and fuel within the float chamber 8 is going to be sucked out from the upper end 5*a* of the main fuel nozzle 5 into the venturi portion 2*a* via the main fuel jet 6 on the basis of the negative pressure.

However, in the solenoid apparatus S, since electric current supply to the electromagnetic coil 15 of the solenoid apparatus S is shut off at the same time when the ignition switch is opened so as to stop the engine, the opening portion 6*a* of the main fuel jet 6 is immediately closed by the valve portion Va of the valve body V, and fuel within the float chamber 8 is inhibited from flowing toward the main fuel jet 6 and the main fuel nozzle 5.

Accordingly, even if negative pressure is generated in the venturi portion 2*a* in the structure mentioned above, fuel is not sucked out toward the inside of the venturi portion 2*a* from the upper end of the main fuel nozzle 5, whereby it is possible to inhibit an after burn phenomenon that unburned fuel reaches an exhaust pipe and is ignited within the exhaust pipe from being generated.

DISCLOSURE OF THE INVENTION

In accordance with the conventional carburetor mentioned above, it is possible to inhibit fuel from being sucked out toward the inside of the venturi portion 2*a* from the upper end 5*a* of the main fuel nozzle 5, in the solenoid apparatus S provided with the valve body V, just after the engine stops, as mentioned above. However, unnecessary fuel is supplied to the inside of the intake passage 2 from the accelerating apparatus P just after the engine stops, and it is hard to completely inhibit the after burn phenomenon within the exhaust pipe from being generated.

This is caused by the following reason.

During the operation of the engine, negative pressure within the intake passage 2*ba* in the downstream side from the throttle valve 3 is always introduced into the pressure receiving chamber 24 via the negative pressure introducing path 30*a*, and the position of the partition body 20 is determined on the basis of a balance of the negative pressure within the pressure receiving chamber 24 and the spring force of the pump spring 31.

The partition body 20 is positioned in the state of having moved to the side of the pressure receiving chamber 24 in any case.

On the other hand, during the operation of the engine, in the pump chamber 23, even if the partition body 20 presses the pump chamber 23 so as to execute the accelerating pump operation, all fuel within the pump chamber 23 is not discharged from the acceleration fuel discharging path 28, and fuel always remains within the pump chamber 23.

In this case, when opening the ignition switch so as to stop the engine, negative pressure within the intake passage 2*ba* in the downstream side from the throttle valve 3 is rapidly and largely lowered (in other words, the negative pressure comes close to the atmospheric pressure in a short period of time). This is because the throttle valve 3 automatically opens the intake passage 2 by the governor mechanism as mentioned above, and the engine rotates at the lower rotating speed in comparison with the normal idling rotating speed.

In accordance with the structure mentioned above, the partition body 20 rapidly moves to the side of the pump chamber 23 from the position just before the engine is stopped, by the pump spring 31 so as to pressurize the pump 23, whereby the fuel remaining within the pump chamber 23 is discharged into the intake passage 2 via the acceleration fuel discharge passage 28 and the accelerating nozzle 27.

Then, the discharged fuel is sucked into the engine on the basis of the air stream within the intake passage 2 generated by inertia rotation of the engine, next reaches the exhaust pipe as unburned fuel, and is ignited within the exhaust pipe so as to sometimes generate the after burn phenomenon.

The present invention is made by taking the problem mentioned above into consideration, and a main object of the present invention is to inhibit an engine after burn phenomenon just after an engine stops operation, particularly in a carburetor provided with a negative actuated type accelerating apparatus, and the other object of the present invention is to achieve the apparatus without increasing the number of the parts and without enlarging a body size of the carburetor.

In accordance with a first aspect of the present invention, in order to achieve the object mentioned above, there is provided an accelerating apparatus of a carburetor sectioned into a pump chamber and a pressure receiving chamber by a partition body, the pump chamber being structured such that an acceleration fuel intake path provided with an intake side check valve in an inner portion and connected to a portion below a fixed liquid surface of a float chamber and an acceleration fuel discharge path provided with a discharge side check valve in an inner portion and connected to an intake passage in an upstream side from a venturi portion via an accelerating nozzle are arranged so as to be open in the pump chamber; and the pressure receiving chamber being provided with a negative pressure actuating type accelerating apparatus, in which a negative pressure introducing path connected to an intake passage in a downstream side from a throttle valve is arranged so as to be open therein, and a solenoid apparatus having a valve body which opens an opening portion of a main fuel jet below the fixed liquid surface within the float chamber at the time of engine operation, and closes the opening portion at the time of engine stop, wherein a fuel discharge path connected to the inside of the float chamber is arranged to be open in the pump chamber, and a jet opening and closing valve portion opening and closing the opening portion of the main fuel jet, and a discharge passage opening and closing valve portion opening and closing the fuel discharge passage are formed in the valve body of the solenoid, wherein, when the engine is operated, the solenoid apparatus opens the opening portion of the main fuel jet by the jet opening and closing valve portion and closes and so keeps the fuel discharge path by the discharge path opening and closing valve portion, and wherein, when the engine stops, the solenoid apparatus closes the opening portion of the main fuel jet by the jet opening and closing valve portion and opens and so keeps the fuel discharge path by the discharge path opening and closing valve portion.

Further, in accordance with a second aspect of the present invention, in addition to the first aspect, the jet opening and closing valve portion of the valve body is formed as a taper-shaped valve portion, and the discharge path opening and closing valve portion is integrally formed by a large-diameter cylindrical valve portion which extends toward the solenoid apparatus side from an end portion of the taper-shaped valve portion, and a small-diameter cylindrical valve portion which extends further toward the solenoid apparatus side from an end portion of the large-diameter cylindrical valve portion.

In accordance with the first aspect of the present invention, during an operation of the engine including an engine start operation in which an ignition switch is closed, an electromagnetic coil of the solenoid apparatus is electrified.

Accordingly, the jet opening and closing valve portion of the valve body holds an open state of the opening portion of the main fuel jet, and the discharge path opening and closing valve portion holds a close state of the fuel discharge path.

In accordance with the structure mentioned above, since fuel within the float chamber can be always supplied into the intake passage from the main fuel jet and the main fuel nozzle, it is possible to well execute the operation including the engine start.

On the other hand, in the negative pressure actuating type accelerating apparatus, since the fuel discharge path is held in the close state by the discharge path opening and closing valve portion, fuel is sucked into the pump chamber via the acceleration fuel intake path at a time of a low opening degree of the throttle valve, the pump chamber is compressed by the partition body at a time when the throttle valve is opened, whereby the fuel within the pump chamber is injected and supplied to the intake passage via the acceleration fuel discharge path and the accelerating nozzle. Accordingly, it is possible to execute the accelerating operation of the engine.

Further, when the ignition switch is opened and the engine stop operation is executed, the current supply to the electromagnetic coil of the solenoid apparatus is shut off. Accordingly, the jet opening and closing valve portion of the valve body holds the close state of the opening portion of the main fuel jet, and the discharge path opening and closing valve portion holds the open state of the fuel discharge path.

In accordance with the structure mentioned above, since fuel within the float chamber is inhibited from flowing into the main fuel jet, the fuel is not sucked out from the opening in the upper end of the main fuel nozzle into the venturi portion even if the air stream is generated within the intake passage in accordance with the inertia rotation of the engine just after the engine stops.

On the other hand, in accordance with the negative actuating type accelerating apparatus, since the fuel discharge path is held in the open state by the discharge path opening and closing valve portion, fuel within the pump chamber is discharged into the float chamber via the fuel discharge path even if the throttle valve is opened by the governor mechanism, pressure within the pressure receiving chamber is rapidly and largely lowered, and the partition body presses the pump chamber by the pump spring so as to compress the pump chamber. Accordingly, the fuel within the pump chamber is not discharged into the intake passage via the accelerating nozzle.

As mentioned above, since unnecessary fuel is not supplied into the intake passage from the main fuel nozzle and the accelerating nozzle at a time of the stop operation of the engine, it is possible to completely dissolve the after burn phenomenon just after the engine stops.

Further, since the fuel discharge path can be provided only by piercing it in the conventional float chamber main body so as to pass through from the pump chamber recess portion toward the inside of the float chamber, and the valve body constituted by the jet opening and closing valve portion and the discharge path opening and closing valve body is operated so as to open and close by the conventionally used single solenoid apparatus, it is possible to maintain a high compatibility and an improved loading characteristic on the engine, without increasing the number of the parts, without enlarging the size of the carburetor, and without changing an outer shape of the carburetor.

Further, in accordance with the second aspect of the present invention, since the valve body is formed by the jet opening and closing valve portion constituted by the taper-shaped valve body, and the discharge path opening and closing valve portion constituted by the large-diameter cylindrical valve portion and the small-diameter cylindrical valve portion, and the taper-shaped valve portion, the large-diameter cylindrical valve portion and the small-diameter cylindrical valve portion are integrally formed, it is possible to form the valve body in a simple shape and a compact size, and it is possible to inexpensively manufacture the valve body.

BEST MODE FOR CARRYING OUT THE INVENTION

Figure 1:
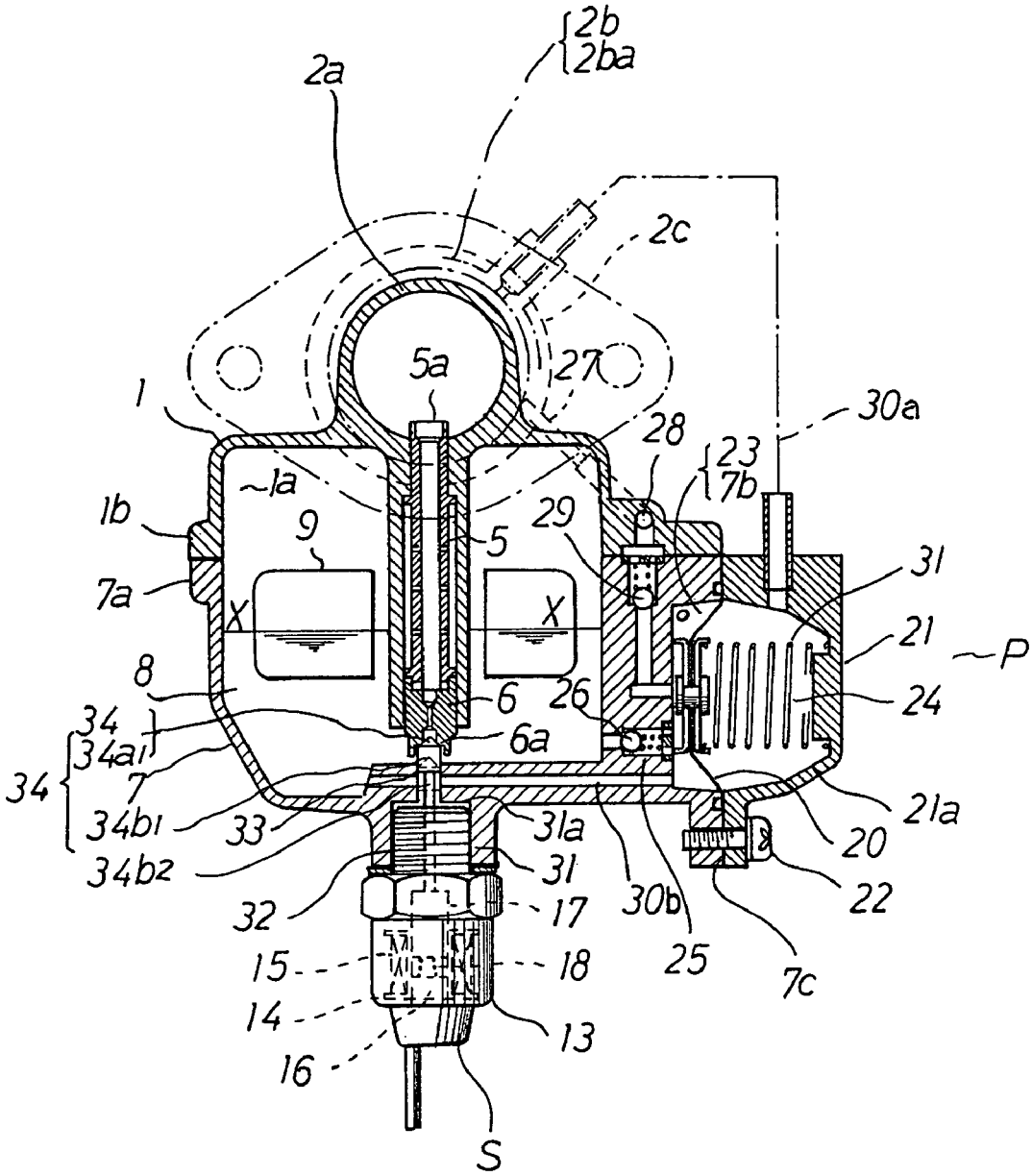
FIG. 1 is a vertical cross sectional view of a main portion showing an embodiment of an accelerating apparatus of a carburetor in accordance with the present invention.

A description will be given below of an embodiment of an accelerating apparatus of a carburetor in accordance with the present invention with reference to FIG. 1.

Figure 4:
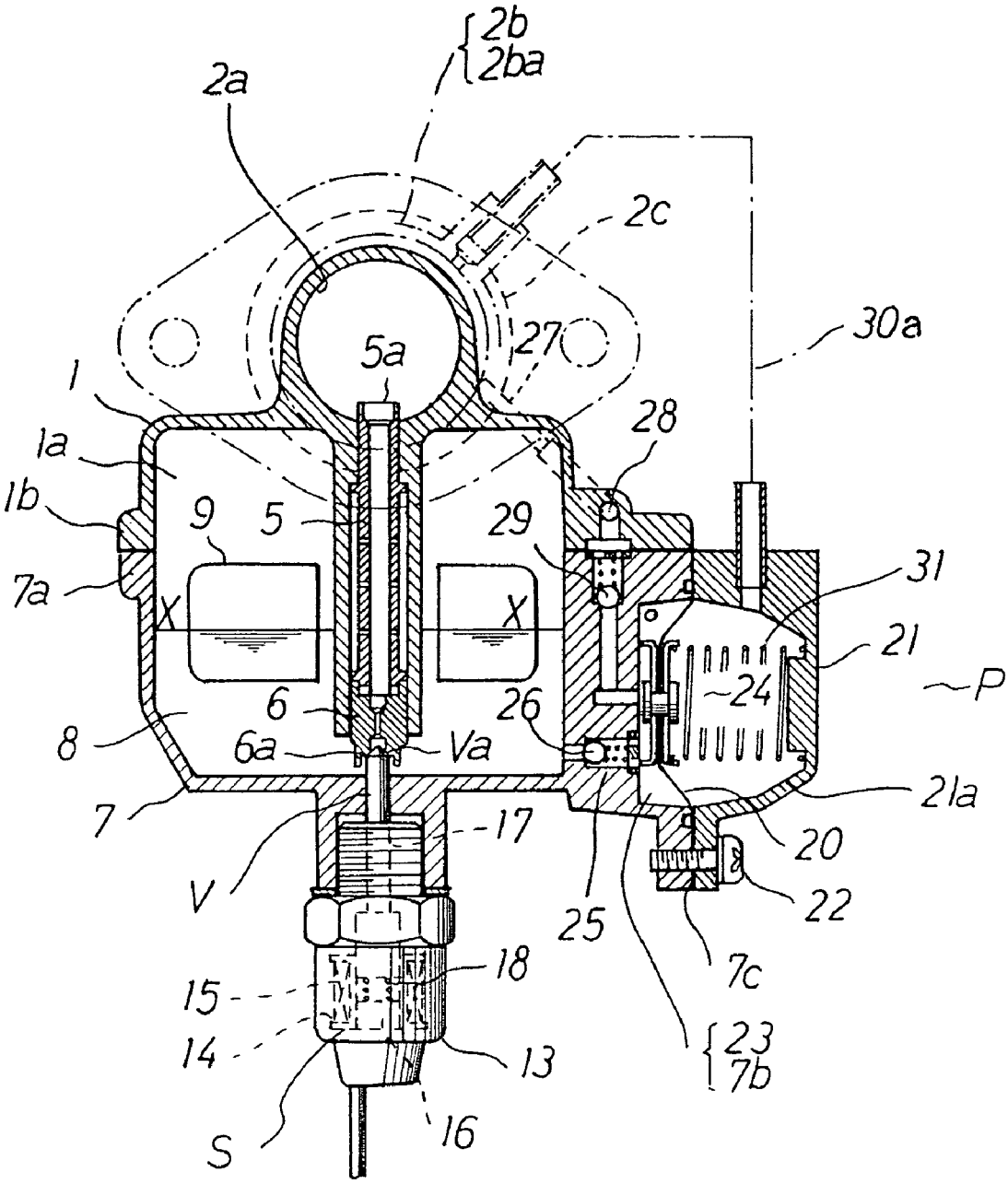
FIG. 4 is a vertical cross sectional view of a main portion showing a conventional accelerating apparatus of a carburetor.
Figure 5:
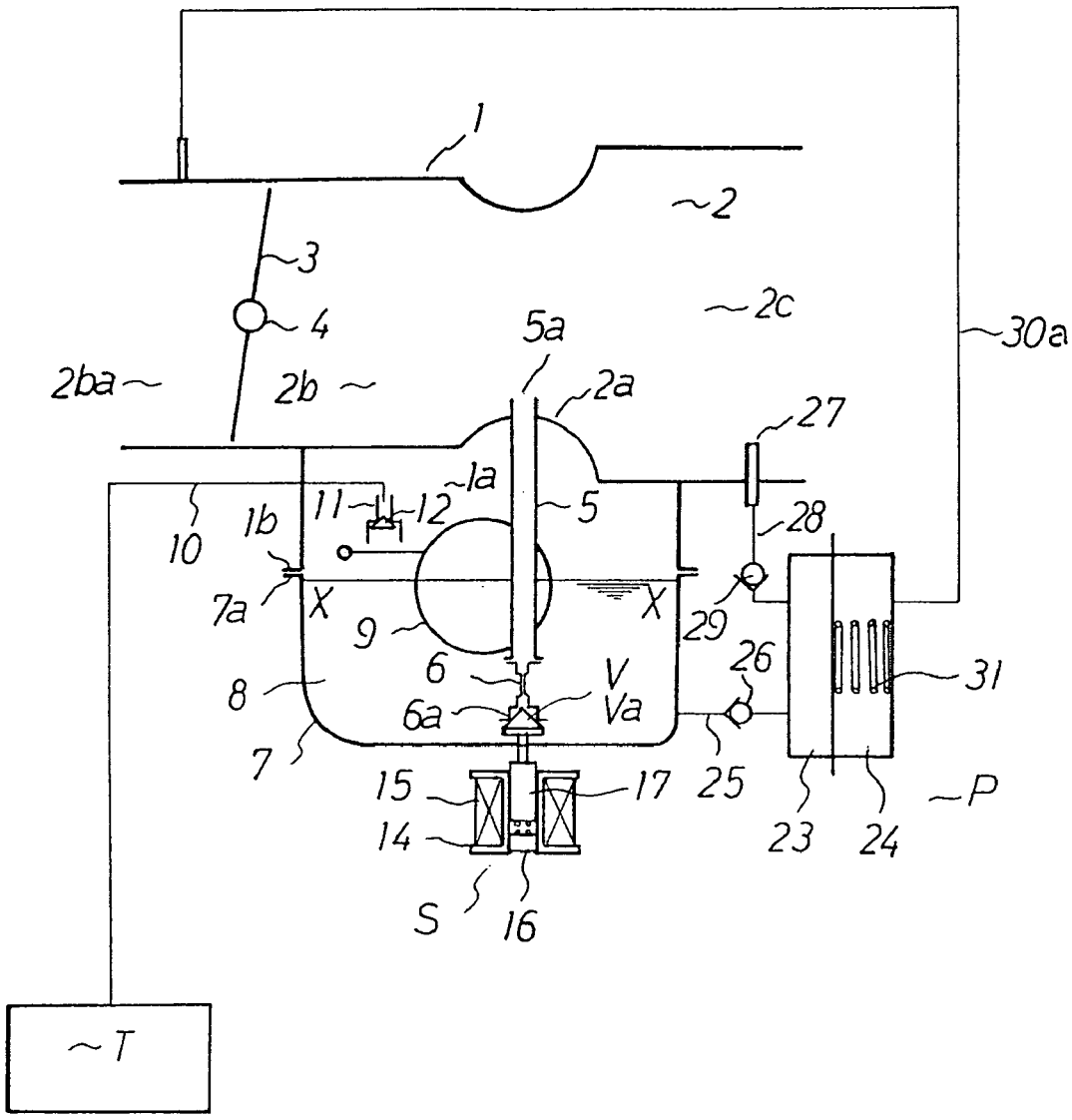
FIG. 5 is an entire system view of the accelerating apparatus of the carburetor in FIG. 4.

In this case, the same reference numerals are used in the same structure portions as those in FIG. 4, and a description thereof will be omitted.

Reference symbol 30*b* denotes a fuel discharge path. The fuel discharge path 30*b* is pierced so as to pass through from a pump chamber recess portion 7*b* toward the inside of a float chamber 8.

Reference numeral 31 denotes a female thread hole engaging with a male thread portion 32 protruding to an upper side of a solenoid apparatus S and formed in a bottom portion of a float chamber main body 7. A valve body guide hole 33 is pierced upward from an upper bottom portion 31*a* of the female thread hole 31 toward the inside of the float chamber 8.

A valve body mentioned below is movably arranged within the valve body guide hole 31 mentioned above.

Further, the fuel discharge path is open to the inside of the float chamber 8 across the valve body guide hole 33.

In other words, the fuel discharge path 30*b* is pierced so as to open to the inside of the valve body guide hole 33.

A valve body 34 integrally moving with a movable core 17 of a solenoid apparatus S is formed in the following manner.

Reference symbol 34*a* denotes a jet opening and closing valve portion constituted by a taper-shaped valve portion 34*a*1 formed in an upper end of the valve body 34. A large-diameter cylindrical valve portion 34*b*1 is formed downward from a lower end of the jet opening and closing valve portion 34*a*, a small-diameter cylindrical valve portion 34*b*2 is formed downward from a lower end of the large-diameter cylindrical valve portion 34*b*1, and a lower end of the small-diameter cylindrical valve portion 34*b*2 is integrally connected to the movable core 17.

A discharge path opening and closing valve portion 34*b* opening and closing the fuel discharge path 30*b* is formed by the large-diameter cylindrical valve portion 34*b*1 and the small-diameter cylindrical valve portion 34*b*2. Summarizing the valve body 34 constituted as mentioned above, the jet opening and closing valve portion 34*a* constituted by the taper-shaped valve body 34*a*1, and the discharge path opening and closing valve portion 34*b* constituted by the large-diameter cylindrical valve portion 34*b*1 and the small-diameter cylindrical valve portion 34*b*2 are concentrically and integrally formed from the upper side toward the lower side of the valve 34.

Further, the valve body is connected so as to integrally move together with the movable core 17 of the solenoid apparatus S, and is slidably arranged within the valve body guide hole 33.

In this case, the large-diameter cylindrical valve portion 34*b*1 of the discharge path opening and closing valve portion 34*b* is slidably arranged with a micro gap with respect to the valve body guide hole 33, and the small-diameter cylindrical valve portion 34*b*2 is arranged with a large gap with respect to the valve body guide hole 33.

Next, a description will be given of an operation thereof.

Since the ignition switch is open in the engine stop state, no current is supplied to the electromagnetic coil 15 of the solenoid apparatus S.

In accordance with the structure mentioned above, the valve body 34 including the movable core 17 is energized to the upper side by a spring force of a spring 18, whereby the jet opening and closing valve portion 34*a* constituted by the taper-shaped valve portion 34*a*1 of the valve body 34 closes the opening portion 6*a* of the main fuel jet 6 and so holds.

Figure 2:
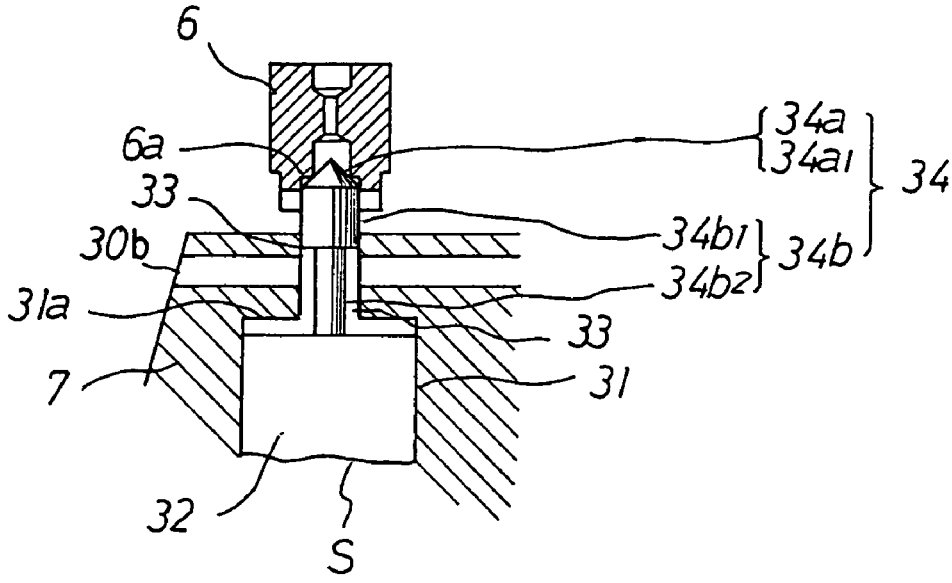
FIG. 2 is an enlarged view of a main portion showing a state of a valve body at a time when a solenoid apparatus is not electrified, in FIG. 1.

On the other hand, the large-diameter cylindrical valve portion 34*b*1 constituting the discharge path opening and closing valve portion 34*b* of the valve body 34 is positioned within the valve body guide hole 33 in the upper side from the fuel discharge path 30*b*, and the small-diameter cylindrical valve portion 34*b*2 is arranged so as to be positioned within the valve body guide 33 to which the fuel discharge path 30*b* is open, whereby the fuel discharge path 30*b* holds the pump chamber 23 and the float chamber 8 in the state of communicating with each other by the small-diameter cylindrical valve portion. This state is shown in FIG. 2.

Next, when closing the ignition switch from the engine stop state and entering into the engine start operation, the current is supplied to the electromagnetic coil 15 of the solenoid coil 15 of the solenoid apparatus S synchronously therewith. Accordingly, the movable core 17 is attracted toward the fixed core 16 against spring force of the spring 18, whereby the valve body 34 moves to a lower side in the drawing and is arranged there.

Figure 3:
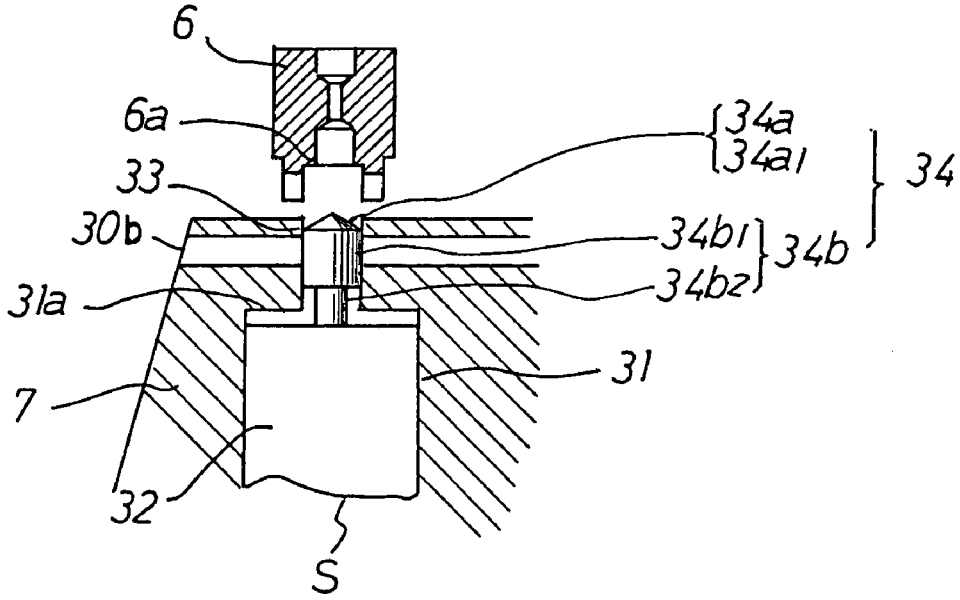
FIG. 3 is an enlarged view of a main portion showing a state of the valve body at a time when the solenoid apparatus is electrified, in FIG. 1.

In accordance with the structure mentioned above, the jet opening and closing valve portion 34*a* constituted by the taper-shaped valve portion 34*a*1 opens the opening portion 6*a* of the main fuel jet 6 and so holds. On the other hand, the large-diameter cylindrical valve portion 34*b*1 including the small-diameter cylindrical valve portion 34*b*2 constituting the discharge path opening and closing valve portion 34*b* also synchronously moves to the lower side, and the large-diameter cylindrical valve portion 34*b*1 enters into the valve body guide hole 33 to which the fuel discharge path 30*b* is open. This state is shown in FIG. 3.

Accordingly, the fuel discharge path 30*b* is closed by the discharge path opening and closing valve portion 34*b*, and the pump chamber 23 and the float chamber 8 are shut off by the fuel discharge path 30*b* and so held.

The state mentioned above is continuously held at the engine start operation time and all the operation time after the start, it is possible to supply fuel within the float chamber 8 to the main fuel jet 6 and the main fuel nozzle 5 via the opening portion 6*a*, and it is possible to well execute all the engine operations in the same manner as the conventional one.

On the other hand, in the accelerating apparatus P, as mentioned above, since at all the engine operation time, the fuel discharge path 30*b* is held in the close state by the discharge path opening and closing valve portion 34*b*, and the pump chamber 23 is held in the close state, fuel within the float chamber 8 can be sucked and held into the pump chamber 23 via the acceleration fuel intake path 25 at the operation time with a low opening degree of the throttle valve 3 in the same manner as the conventional one, the pump chamber 23 is compressed by the partition body 20 at the time of opening the throttle valve 3, and fuel stored and held within the pump chamber 23 is injected and supplied into the intake passage 2 via the acceleration fuel discharge path 28 and the accelerating nozzle 27, whereby a predetermined accelerating operation can be executed.

Further, when opening the ignition switch and entering into the engine stop operation state from the engine operation state, the current supply to the electromagnetic coil 15 of the solenoid apparatus S is shut off. Accordingly, the valve body 34 including the movable core 17 moves upward by spring force of the spring 18, and returns again to the state shown in FIG. 1.

In other words, the jet opening and closing valve portion 34*a* constituted by the taper-shaped valve portion 34*a*1 closes the opening portion 6*a* of the main fuel jet 6, the small-diameter cylindrical valve portion 34*b*2 of the discharge path opening and closing valve portion 34*b* holds to open the fuel discharge path 30*b*, and the pump chamber 23 and the float chamber 8 communicate by the fuel discharge path 30*b*. In accordance with the structure mentioned above, since after the engine stop operation, the throttle valve 3 is opened by the governor mechanism, and the engine continues inertia rotation, fuel is not sucked out to the venturi portion 2*a* via the main fuel jet 6 and the main fuel nozzle 5 even if the air stream is generated within the intake passage 2 and the negative pressure is generated in the venturi portion 2*a*.

On the other hand, in the case that the throttle valve 3 is opened, even if the negative pressure within the intake passage 2*ba* in the downstream side from the throttle valve 3 is lowered, whereby the partition body 20 is pressed to the side of the pump chamber 23 by the spring force of the pump spring 31 and the pump chamber 23 is compressed, fuel staying within the pump chamber 23 is discharged into the float chamber 8 via the fuel discharge path 30*b* having a small flow resistance, and the fuel within the pump chamber 23 is not injected toward the intake passage 2 via the acceleration fuel discharge path 28 and the accelerating nozzle 27.

As mentioned above, since fuel is not sucked out toward the inside of the intake passage 2 from the main fuel nozzle 5 and the accelerating nozzle 27 at a time of executing the engine stop operation, it is possible to completely inhibit the after fire from being generated in the engine stop operation.

Further, in accordance with the present invention, the fuel discharge path 30*b* can be extremely easily formed in the conventional float chamber main body 7 and it is not necessary to enlarge the size of the float chamber main body 7.

Further, since the solenoid apparatus S is single and can divert the conventional solenoid apparatus as it is, it is possible to inhibit the number of component parts from being increased and the body size of the carburetor is not enlarged.

Accordingly, the carburetor can be achieved by modifying the conventional carburetor a little, and can be loaded on an engine within the conventional receiving space range, so that the carburetor has a compatibility with respect to the conventional carburetor.

Further, according to the structure that the valve body 34 is connected with and integrally formed with the jet opening and closing valve body 34*a* constituted by the taper-shaped valve portion 34*a*1, and the discharge path opening and closing valve portion 34*b* constituted by the large-diameter cylindrical valve portion 34*b*1 and the small-diameter cylindrical valve portion 34*b*2, they can be worked and formed in accordance with a one chuck work on the basis of a lathe turning process, and it is possible to extremely accurately and concentrically form the taper-shaped valve portion 34*a*1 and the small-diameter cylindrical valve portion 34*b*2.

Further, the valve body 34 can be made simple in shape, and can be made compact in size.

What is claimed is:

1. An accelerating apparatus of a carburetor sectioned into a pump chamber and a pressure receiving chamber by a partition body, the pump chamber being structured such that an acceleration fuel intake path provided with an intake side check valve in an inner portion and connected to a portion below a fixed liquid surface of a float chamber and an acceleration fuel discharge path provided with a discharge side check valve in an inner portion and connected to an intake passage in an upstream side from a venturi portion via an accelerating nozzle are arranged so as to be open in the pump chamber; and the pressure receiving chamber being provided with a negative pressure actuating accelerating apparatus, in which a negative pressure introducing path connected to an intake passage in a downstream side from a throttle valve is arranged so as to be open therein, and a solenoid apparatus having a valve body which opens an opening portion of a main fuel jet below the fixed liquid surface within the float chamber at the time of engine operation, and closes the opening portion at the time of engine stop, wherein a fuel discharge path (30*b*) connected to the inside of the float chamber (8) is arranged to be open in said pump chamber, and a jet opening and closing valve portion (34*a*) opening and closing the opening portion (6*a*) of the main fuel jet (6), and a discharge passage opening and closing valve portion (34*b*) opening and closing the fuel discharge passage (30*b*) are formed in the valve body (34) of said solenoid apparatus, wherein, when the engine is operated, the solenoid apparatus (S) opens the opening portion (6*a*) of the main fuel jet (6) by the jet opening and closing valve portion (34*a*) and closes and so keeps the fuel discharge path (30*b*) by the discharge path opening and closing valve portion (34*b*), and wherein, when the engine stops, the solenoid apparatus (S) closes the opening portion (6*a*) of the main fuel jet (6) by the jet opening and closing valve portion (34*a*) and opens and so keeps the fuel discharge path (30*b*) by the discharge path opening and closing valve portion (34*b*).

2. An accelerating apparatus of a carburetor as claimed in claim 1, wherein the jet opening and closing valve portion (34*a*) of said valve body is formed as a taper-shaped valve portion (34*a*1), and the discharge path opening and closing valve portion (34*b*) is integrally formed by a large-diameter cylindrical valve portion (34*b*1) which extends toward the solenoid apparatus (S) side from an end portion of the taper-shaped valve portion (34*a*1), and a small-diameter cylindrical valve portion (34*b*2) which extends further toward the solenoid apparatus (S) side from an end portion of the large-diameter cylindrical valve portion (34*b*1).

* * * * *